United States Patent [19]

Steele

[11] 4,290,636

[45] Sep. 22, 1981

[54] SECURITY DEVICE

[76] Inventor: Richard J. Steele, 2202 Harwell, Houston, Tex. 77026

[21] Appl. No.: 116,558

[22] Filed: Jan. 29, 1980

[51] Int. Cl.[3] ..... E05C 17/36

[52] U.S. Cl. ..... 292/338

[58] Field of Search ..... 292/338, 339, DIG. 15, 292/264, 258

[56] References Cited

U.S. PATENT DOCUMENTS

| | | | |
|---|---|---|---|
| 1,944,783 | 1/1934 | Ciriocy et al. | 292/338 |
| 2,491,246 | 12/1949 | Bloomfield | 292/338 |
| 2,774,622 | 12/1956 | Priebe | 292/339 |
| 2,955,863 | 10/1960 | Olender | 292/264 |
| 4,019,765 | 4/1977 | Nichola | 292/338 |

*Primary Examiner*—Richard E. Moore

*Attorney, Agent, or Firm*—Ranseler O. Wyatt

[57] ABSTRACT

A security device for use on inwardly opening doors, having a holding plate mountable beneath the knob of the door on which a bar is mounted, and a foot member, pivotally mounted on the lower end of the bar, is adapted to move inwardly a preselected distance from the door, and will direct a force upwardly against the door casing when an inward pressure is applied to the door.

1 Claim, 2 Drawing Figures

SECURITY DEVICE

BACKGROUND OF THE INVENTION

The customary security bar presently in use extends across the face of the door, so that a thin object may be inserted between the door and facing, lifting the bar out of its seat, or an intruder may apply pressure to the door, tearing the bar seats out of the door casing. It is an object of this invention to provide a bar that may be placed in security position inside of the building and which may be quickly and easily removed and stored out of the way from the inside of the building, and that will not be dependent upon screws mounted in the door facing to resist an intruder, but rather will cause inward pressure applied against the door to be applied to aid in preventing the opening of the door.

SUMMARY OF THE INVENTION

A security device to be mounted on the inside of the door of a building, beneath the door knob, having an extended bar with a foot on the extended end and a fastening means for maintaining the foot in position to direct any pressure from the outside against the door in an upwardly direction against the door casing, and preventing inward movement of the door.

DESCRIPTION OF THE PREFERRED EMBODIMENT

Figure 1:
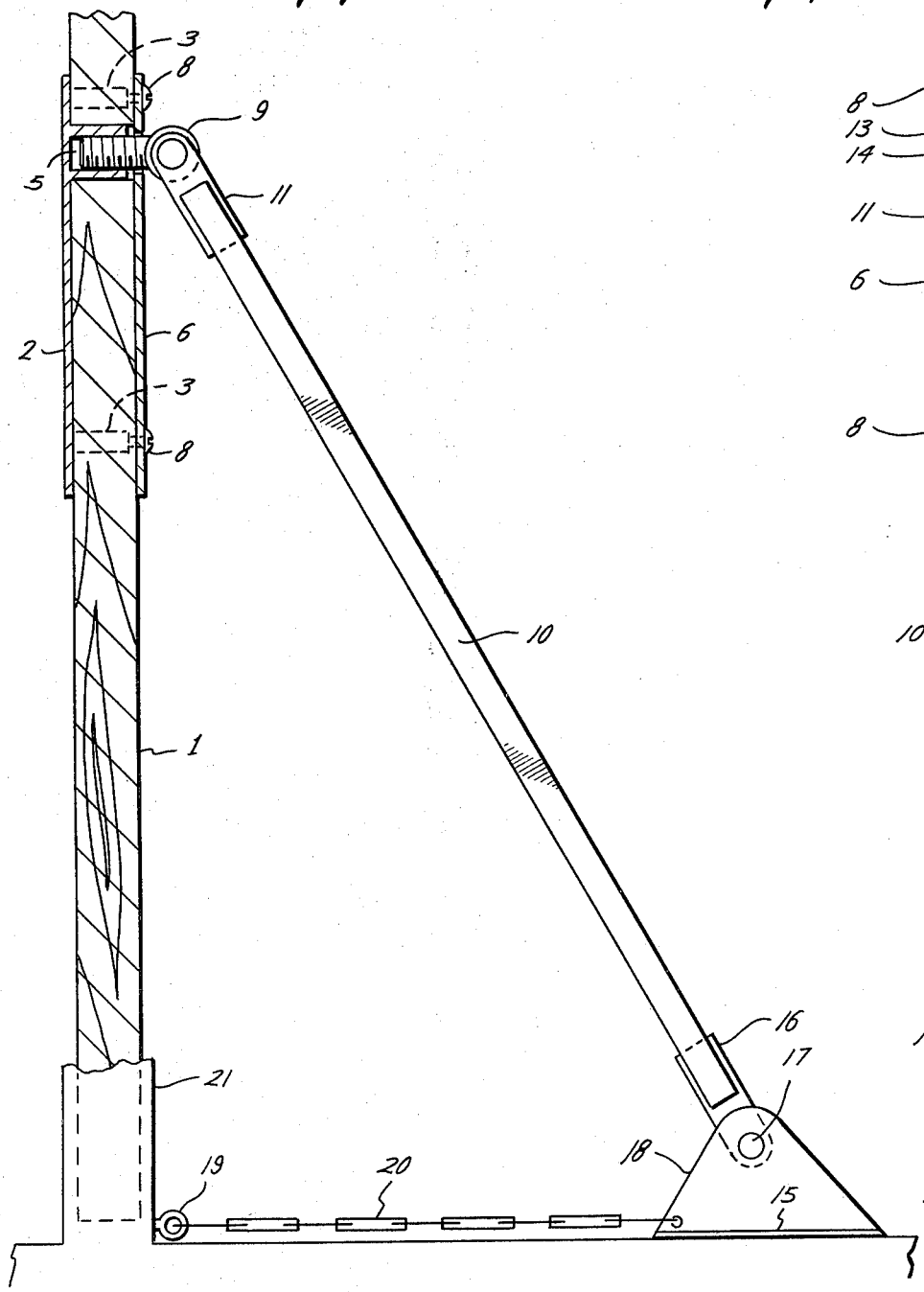
FIG. 1 is a side elevational view of the device installed on a door, partially in cross section.
Figure 2:
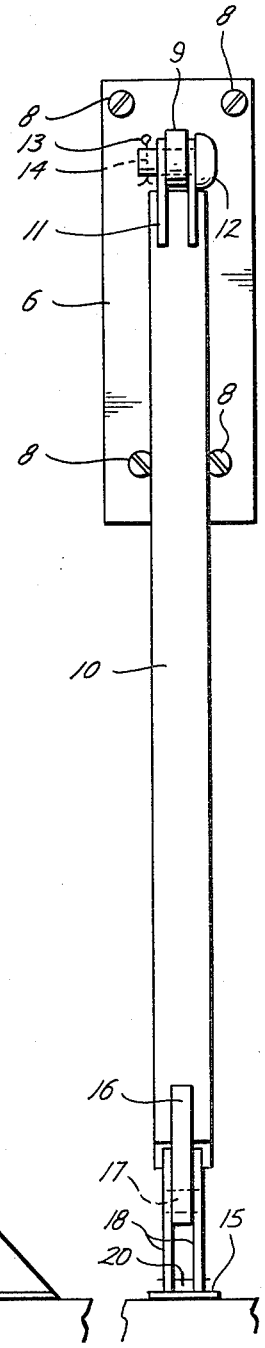
FIG. 2 is a front elevational view of the device.

In the drawings the numeral 1 designates a door facing on which an outer plate 2 is mounted on the outside of the door, beneath the door top (not shown). The plate 2 is provided with bolt receiving sockets 3, 3 which are inwardly threaded to receive the bolts 4, 4. A large, internally threaded socket 5 is formed adjacent the upper end of the plate 1, and extends inwardly. An inner plate 6, of the same dimensions as the outer plate 1, having bolt holes therein to receive the bolts 7, 7 and having a large bolt hole 8 to receive an eye-bolt 9. The bar 10 has a clevis 11 at one end through which the pin 12 is inserted as the clevis is placed astride the eye of the eye-bolt 9 and a pin 13 may be inserted in the port 14 in the extended end of the pin 12 to maintain the pin releasably secured in place.

A base member 15 is pivotally mounted on the lower end of the bar 10 by means of the integral connecting member 16, having the pin 17 securing the connecting member to the upstanding side members 18, 18 of the foot 15'.

Deeply anchored into the stud (not shown) adjacent the door face 21 is the eye-screw 19 to which a chain, or the like 20 is secured at one end and with its other end secured to the side members 18, 18 adjacent the foot member 15'.

In use, the door, as 21, on which the device is to be mounted, will have holes to receive the sockets 3, 3 and 5, spaced immediately below the door knob, and the plate 2 is mounted on the outside of the door surface, and the plate 6 positioned diametrically opposite the plate 2, and the screws 8, 8 mounted in the sockets 3, 3, and the eye-bolt 9 mounted in the socket 5. The bar and base member assembly will then be mounted on to the eye-bolt 9 by means of the pin 12, and the pin 12 secured in place, and the base member pivoted outwardly away from the door to the predetermined distance from the door, limited by the chain 20. Pressure from the outside against the door will direct a force upwardly against the top of the door casing 21, and will prevent the inward movement of the door.

What I claim is:

1. In a security device, plates mounted on the door, an inwardly extending pivotally mounted bar mounted at one end on said plates, a base member pivotally mounted on the other end of said bar, means for maintaining said base member at a preselected distance inwardly from said door, said plates comprising an outside plate and an inside plate, the outside plate having inwardly extending, inwardly threaded sockets and the inside plate having ports to receive mounting screws and an enlarged port to receive an eye-bolt to which the said bar is mounted.

* * * * *